US006996854B2

(12) United States Patent
Montana, II

(10) Patent No.: US 6,996,854 B2
(45) Date of Patent: Feb. 14, 2006

(54) CAN CARTON CAP

(76) Inventor: Peter A. Montana, II, 1660 E. River Rd., Grand Island, NY (US) 14072

( * ) Notice: Subject to any disclaimer, the term of this patent is extended or adjusted under 35 U.S.C. 154(b) by 236 days.

(21) Appl. No.: 10/065,113

(22) Filed: Sep. 18, 2002

(65) Prior Publication Data

US 2004/0149814 A1 Aug. 5, 2004

(51) Int. Cl.
*A42B 1/00* (2006.01)

(52) U.S. Cl. ..... 2/200.3

(58) Field of Classification Search ..... 2/200.3, 2/175.1, 200.1

See application file for complete search history.

(56) References Cited

U.S. PATENT DOCUMENTS

| | | | | | |
|---|---|---|---|---|---|
| 1,418,198 | A * | 5/1922 | Neppell | 2/209.7 |
| 2,083,000 | A * | 6/1937 | Bennard | 2/209.11 |
| 4,429,420 | A * | 2/1984 | Wolff | 2/175.1 |
| 5,121,506 | A * | 6/1992 | Ulrich | 2/171.5 |
| 5,553,327 | A * | 9/1996 | Koecher et al. | 2/200.3 |
| 6,101,633 | A * | 8/2000 | Thompson | 2/200.1 |
| 6,561,393 | B1 * | 5/2003 | Cheng | 2/171.03 |

* cited by examiner

*Primary Examiner*—Katherine Moran
(74) *Attorney, Agent, or Firm*—Richard D. Fuerle

(57) ABSTRACT

A hat is made from a can carton that has a pattern marked on it. The pattern is cut out and the hat is assembled from the pieces. An 18 or 24 can carton can be used to make the brim of the hat and 12 and 18 can cartons can be used to make the crown. Hats of various shapes and styles can be made from the cartons.

19 Claims, 12 Drawing Sheets

CAN CARTON CAP

BACKGROUND OF INVENTION

This invention relates to a can carton having a pattern printed thereon for constructing a hat therefrom, to a method of constructing a hat using a can carton, and to a hat constructed from a can carton. In particular, it relates to 12, 18, and 24 can cartons from which hats can be made using patterns marked on the inside of the carton.

At parties and bars where beer and/or soft drinks are imbibed, it is desirable to have unique and attention-grabbing hats, tee shirts, and other items to help "break the ice," facilitate conversation, and help people to get acquainted. While the host can provide such items, they are usually mass-produced so that everyone has an identical item. As such, they are only marginally effective at promoting social interactions.

SUMMARY OF INVENTION

I have discovered that unique hats can be made from can cartons using a pattern that can be printed on the carton. Each hat can display the logo on the carton, so each hat can be different depending upon the type of product that was in the carton. In addition, a variety of different types of hats can be made from the cartons. As a result, the hats make it easy to start a conversation with the wearer, as one need only comment on the hat or ask the wearer if he or she likes the brand displayed.

DETAILED DESCRIPTION

Any type of can carton can be used in this invention. Can cartons are typically made of cardboard or heavy paper, but other similar types of materials, such as plastic, could also be used. The can carton can hold beer, soda pop, fruit juices, tea, flavored and non-flavored water, or energy drinks. Can cartons typically hold 12, 18, or 24 cans, each of which holds 12 oz of fluid, but cartons holding other numbers of cans or can of other sizes could also be used. The following table gives the dimensions currently used for 12, 18, and 24 can cartons: [t1]

| Size | Height (inches) | Length (inches) | Width (inches) |
|---|---|---|---|
| 12 can | 7¾ | 10½ | 4¾ |
| 18 can | 7¾ | 15½ | 4¾ |
| 24 can | 10½ | 15½ | 4¾ |

Thus, for example, the top and bottom of a 12 can carton measure 4¾×7¾ inches, the front and back sides measure 4¾×10½ inches, and the other 2 sides measure 4¾×7¾. Of course, can carton dimensions can change and this invention would still be application to cartons of other dimensions.

A pattern can be printed on the carton which shows where to cut and fold the carton in order to construct various types of hats, where "hat" is intended to mean any type of apparel worn on the head. Preferably, the pattern is printed on the inside of the carton, but it could also be printed on the outside of the carton.

Figure 1:
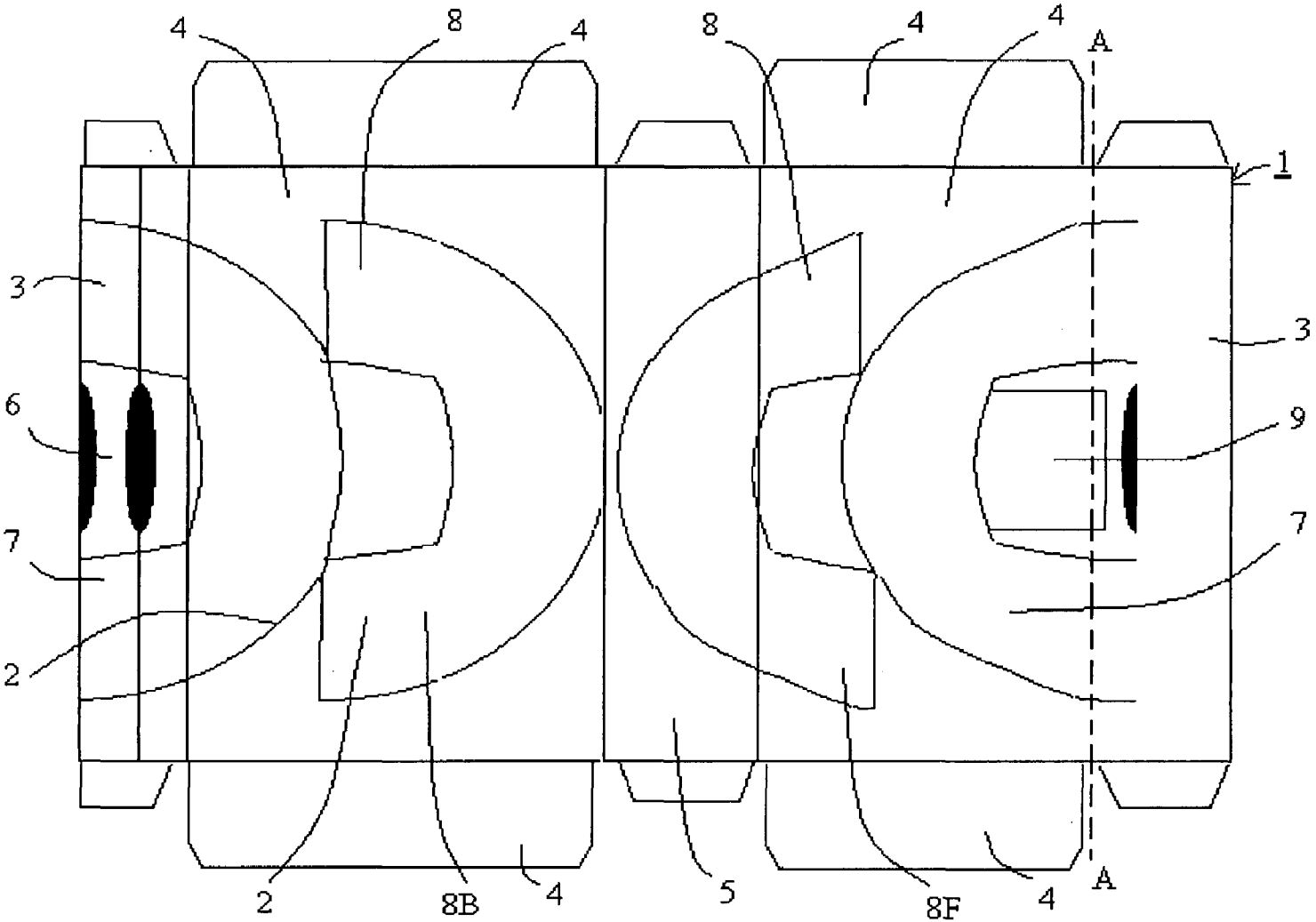
FIG. 1 is a plan view of a 24 can carton, as manufactured before gluing, having a pattern printed thereon.
Figure 2:
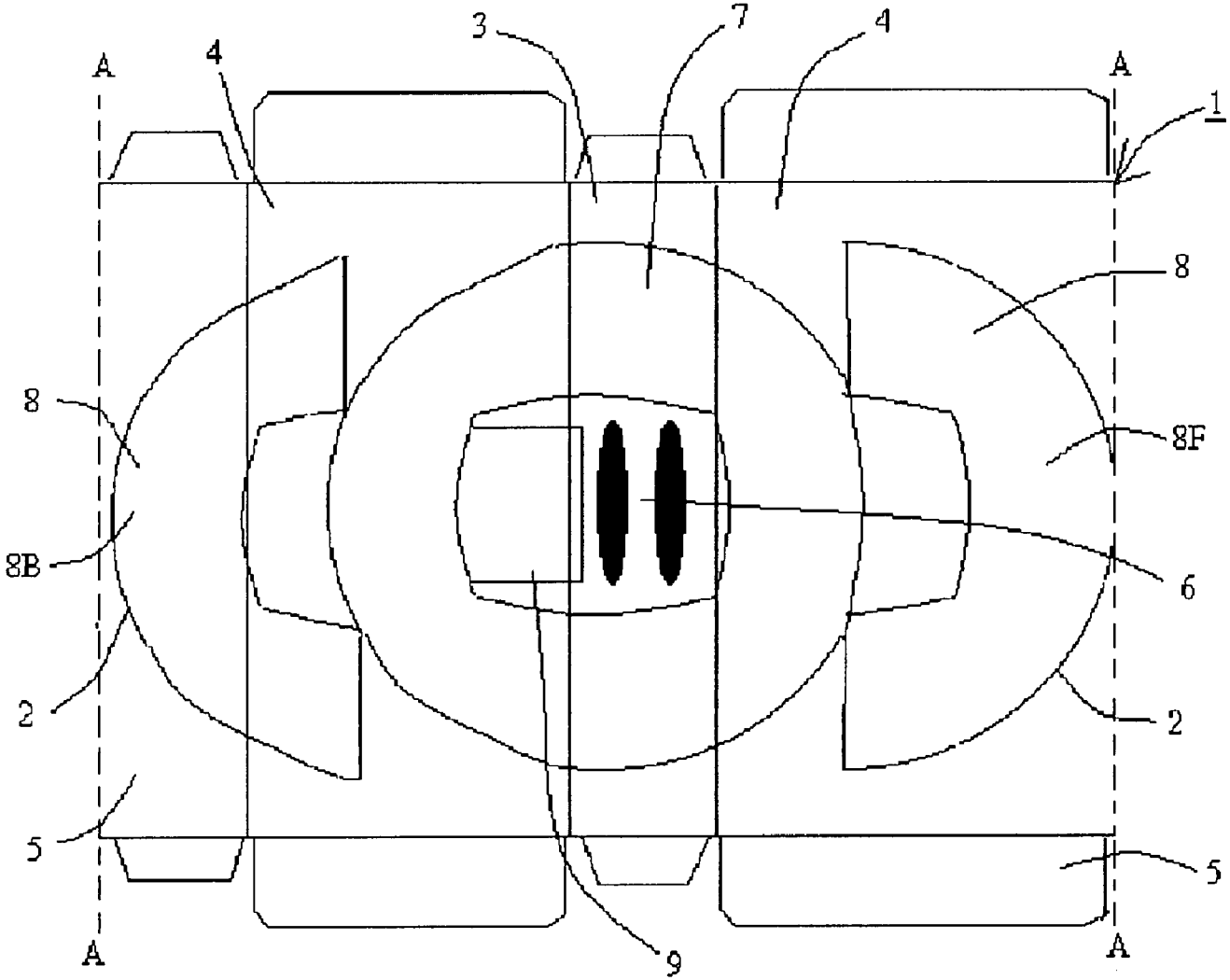
FIG. 2 is a plan view of the carton of FIG. 1 after it has been assembled, emptied, cut along line A—A, and laid flat.

The accompanying drawings show how a hat can be made using two can cartons, a 24 can carton and either a 12 can carton, an 18 can carton, or another 24 can carton. In FIGS. 1 and 2, can carton 1 has patterns 2 printed on it. Usually, patterns 2 will be printed on the inside of the carton, but some or all of the patterns could be printed on the outside of the carton. Instead of printing the patterns on the cartons, the patterns could be marked on the cartons by perforations, or by stamps or dies in the shape of the patterns, which also cut the patterns out, or by some other means. The patterns may be marked on the can cartons by a cutting tool as it cuts the pieces from the can cartons.

Portions 3, 4, and 5 of carton 1 form a top, sides, and a bottom of the assembled carton, where the "top" of the carton has handle 6 on it and is the uppermost part of the carton when the designs and writing on the carton are in an upright position. Instructions printed on the carton (not shown) tell the reader to cut along the lines of pattern 1, forming three parts, an upper brim 7 and a lower brim 8, which has two parts, a front lower brim 8F and a back lower brim 8B. Alternatively, by using another 24 can carton, upper brim 7 can be duplicated and used to form a single piece lower brim 8. Logo piece 9 is also printed on carton 1. These patterns have been positioned on the carton so that the manufacturer's carton designs are best displayed on the hat when the hat is assembled. Logo piece 9, for example, is positioned so that the manufacturer's logo piece appears on the opposite side.

Figure 3:
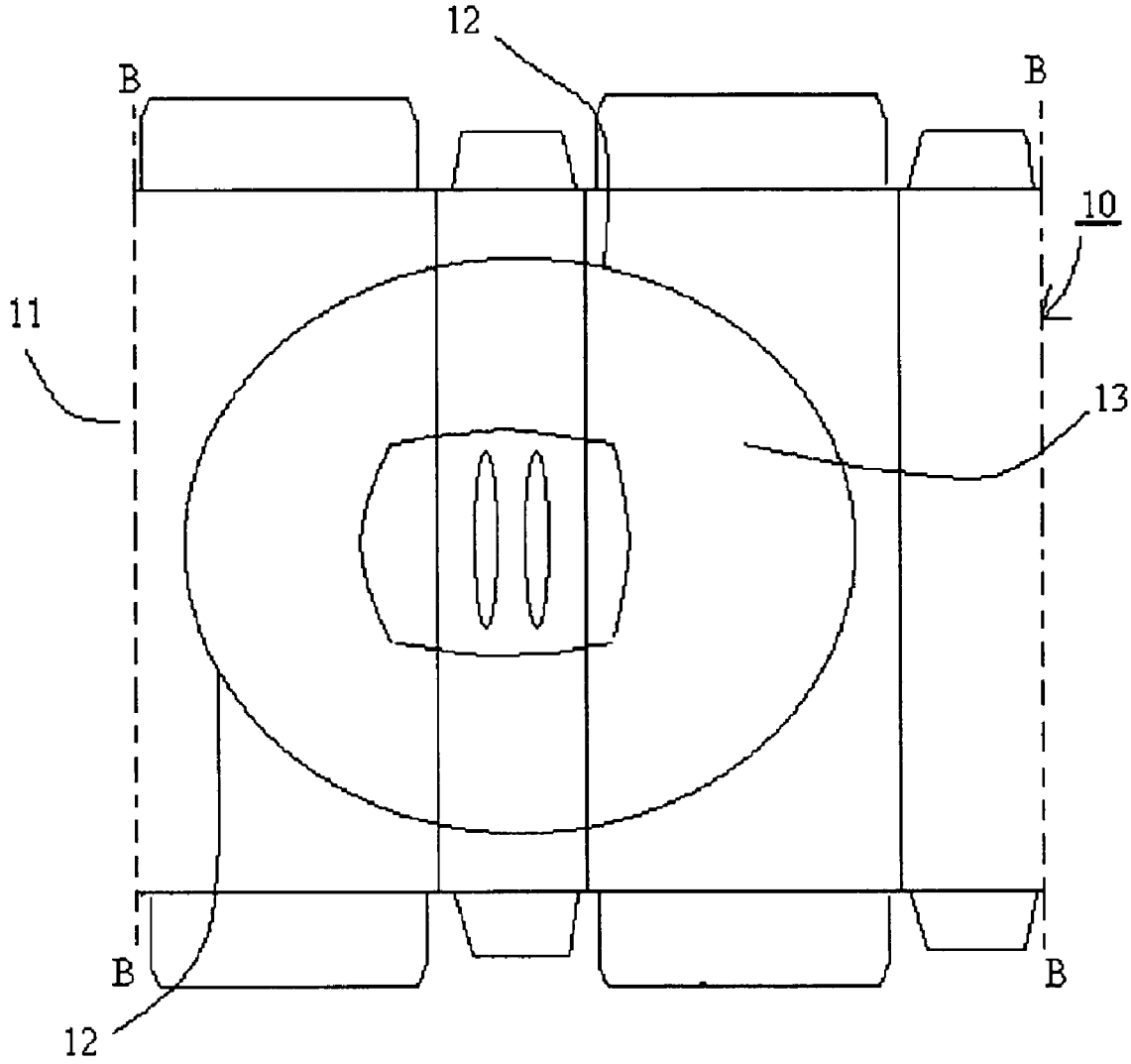
FIG. 3 is a plan view of a flattened-out 18 can carton after it has been assembled, emptied, cut along line B—B, and laid flat.

As another alternative, the upper and lower brims can be made from two 18 can cartons. FIG. 3 shows an 18 can carton 10 that has been cut at 11 (line B—B) and then laid flat. A pattern 12 for an upper or lower brim 13 has been printed on the inside of the carton.

Figure 4:
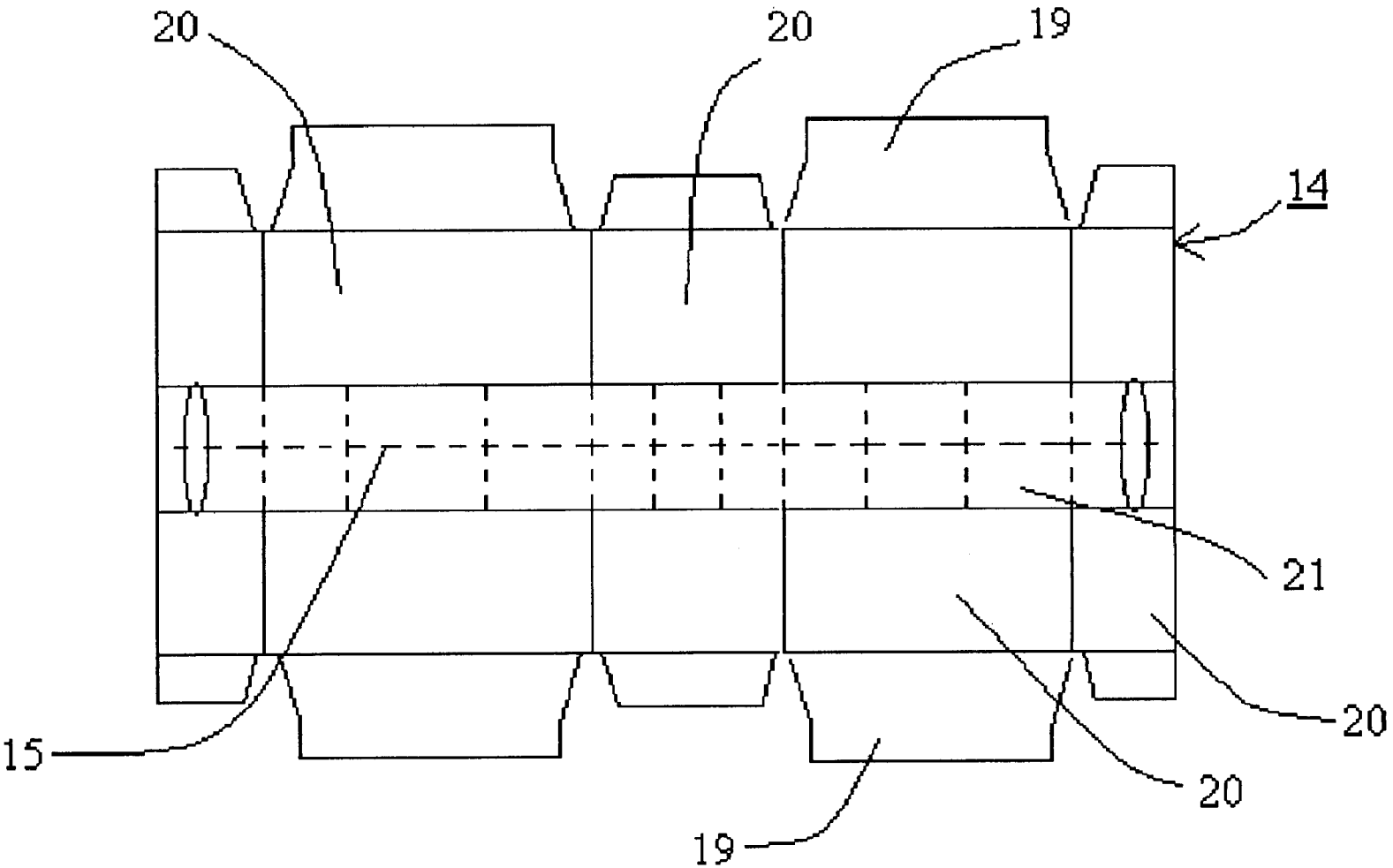
FIG. 4 is a plan view of a 12 can carton, as manufactured before gluing, having a pattern printed thereon.
Figure 5:
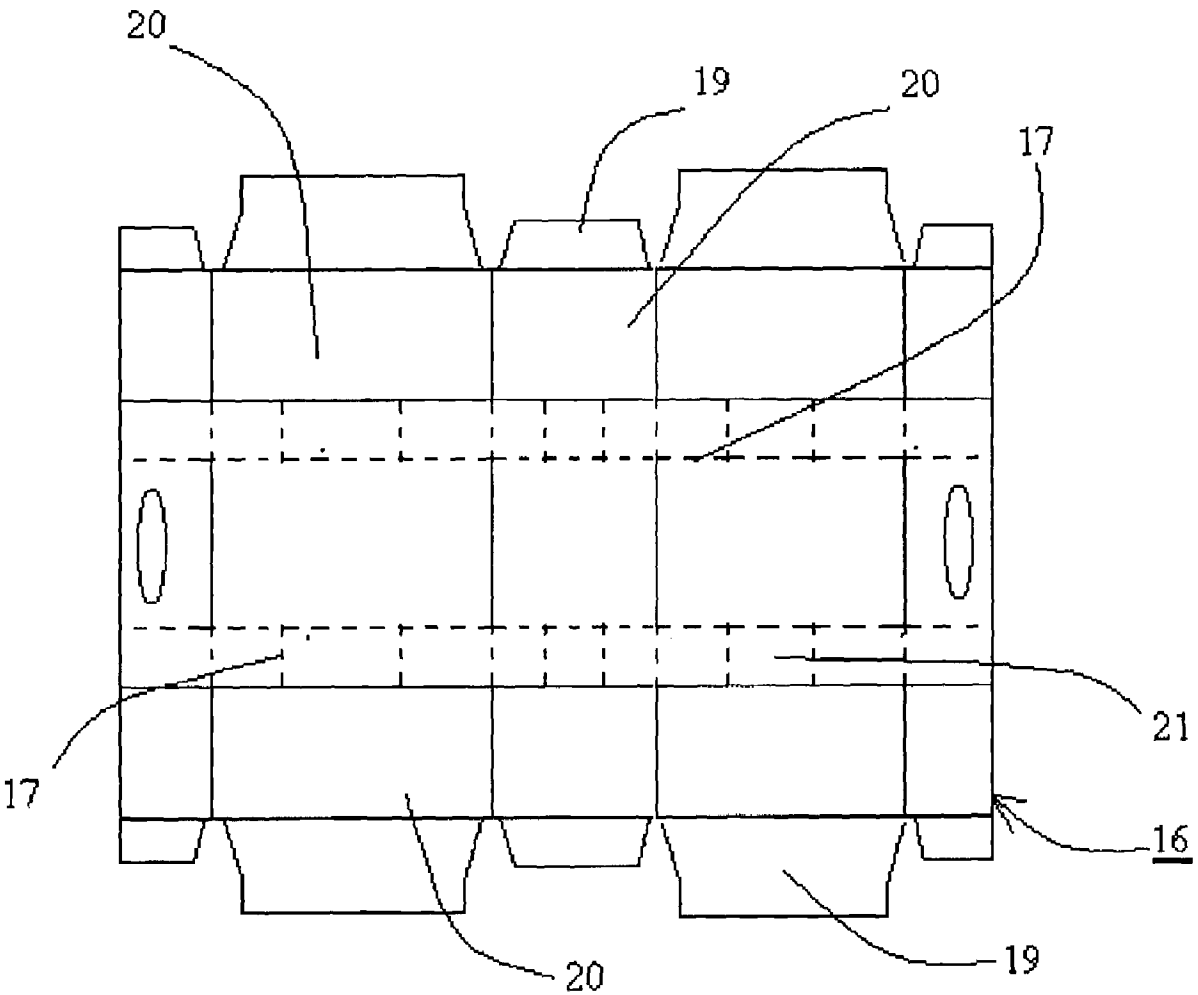
FIG. 5 is a plan view of an 18 can carton, as manufactured before gluing, having a pattern printed thereon.
Figure 6:
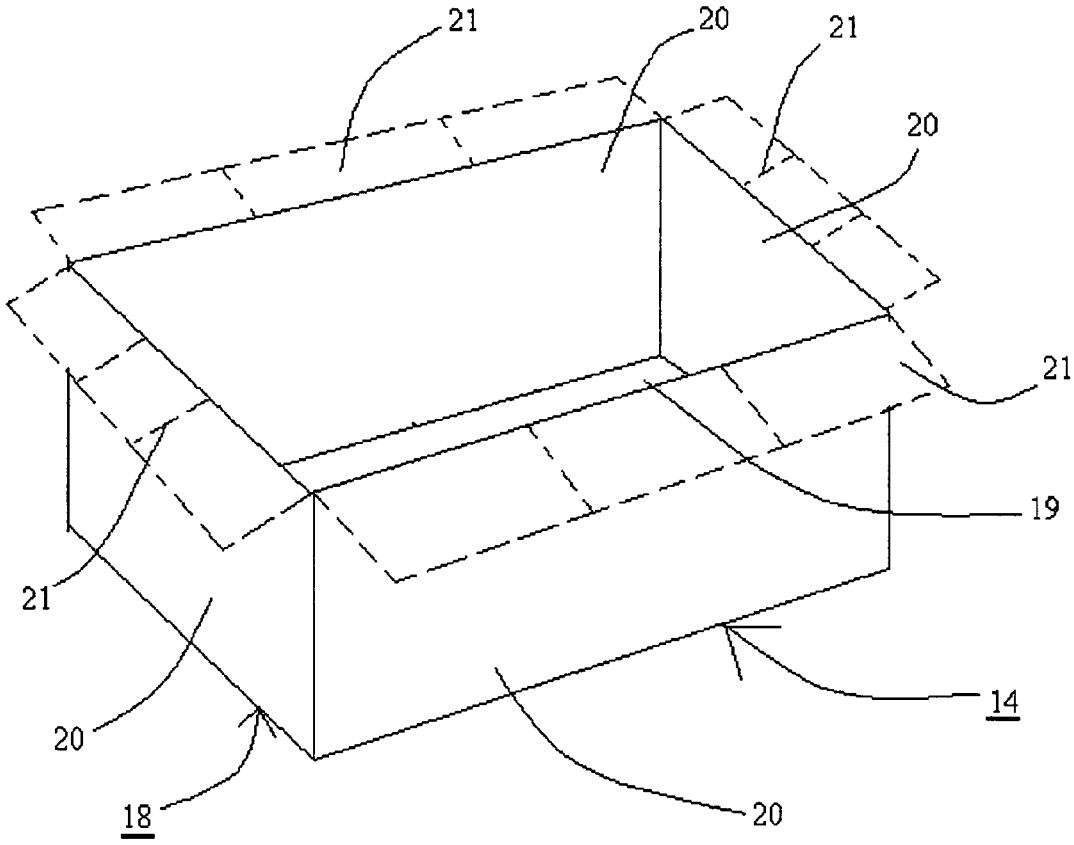
FIG. 6 is an isometric view of half of a vertically-cut 12 can carton.

Referring now also to FIG. 4, 12 can carton 14 has pattern 15 printed on it and, in FIG. 5, 18 can carton 16 has patterns 17 printed on it. After cartons 14 and 16 have been assembled, filled with cans, and emptied, they are cut along the dotted lines in FIGS. 4 and 5 (i.e., the cartons are cut vertically through the top, sides, and bottom). This forms parts from the ends of the cartons that are identical except for designs and writing on the cartons. Each of these parts will form crown 18 having a rectangular cross-section, as shown in FIG. 6. In FIG. 6, crown 18 has a top 19, sides 20, and tabs 21 extending at a 90° to sides 20. (See FIGS. 4 and 5 for the positions of top 19, sides 20 and tabs 21 on the laid out carton.) Tabs 21 preferably extend outward about ¾ to about 2 inches from sides 20.

Figure 7:
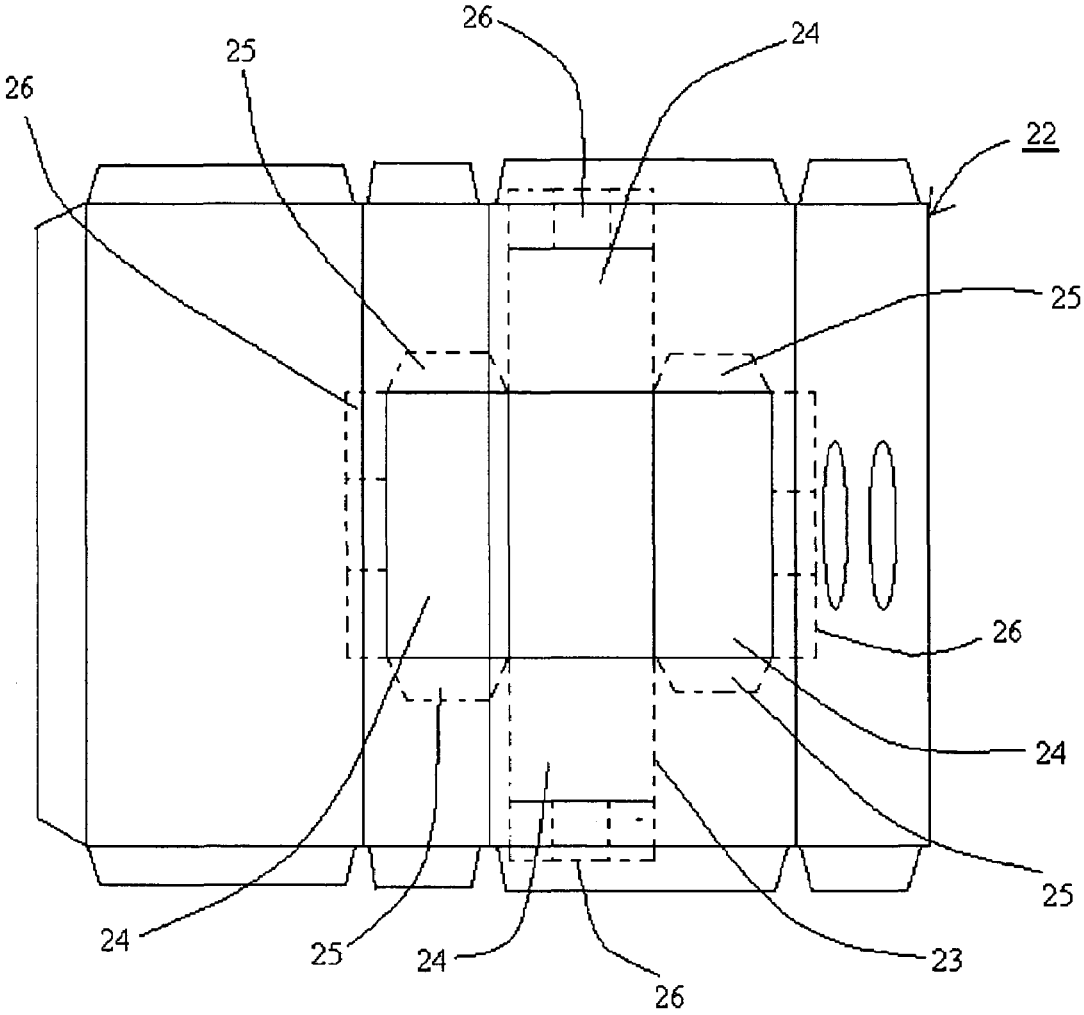
FIG. 7 is a plan view of a flattened-out 24 can carton having a pattern printed thereon.
Figure 8:
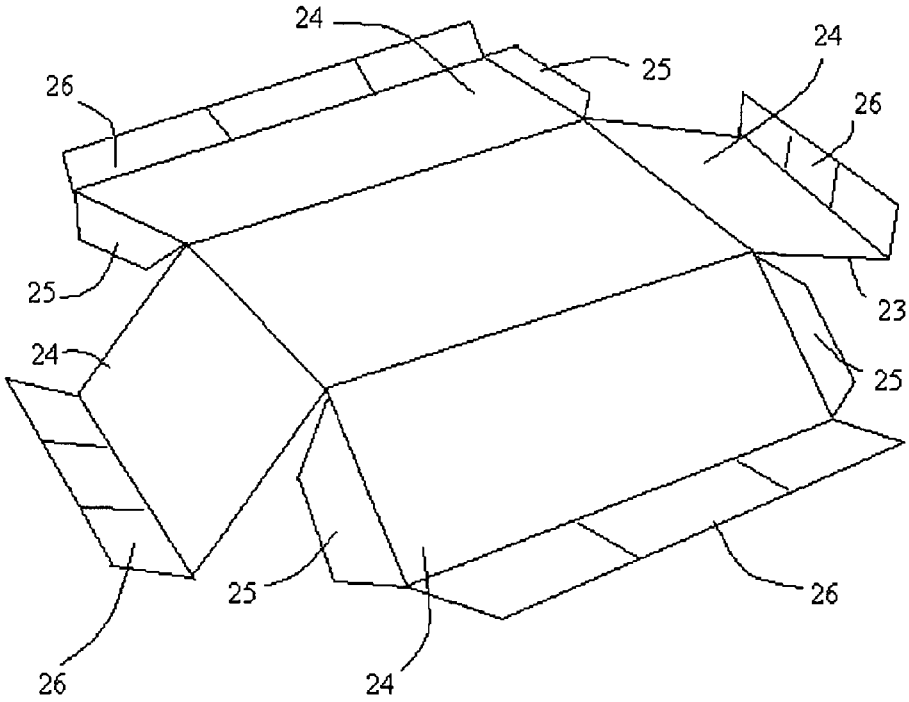
FIG. 8 is an isometric view showing a pattern being assembled into the crown of a hat.

FIG. 7 is similar to FIG. 2 in that it shows a 24 can carton 22 laid flat, but the pattern 23 printed thereon is for making a crown, which can be larger or smaller than the crowns shown in FIG. 6. The pattern is cut along the dotted lines, sides 24 are folded upward at 90°, and tabs 25 are glued, stapled, or otherwise fixed to sides 24. Tabs 26 are cut where the dotted lines indicate and are folded at 90° to sides 24. FIG. 8 shows the cut-out pattern 23 (inverted) of FIG. 7 in the process of being assembled into a crown. Tabs 25 are attached to sides 24 and tabs 26 will slide in between the upper brim and the lower brim. Thus, as shown in FIGS. 4, 5, 6, 7, and 8, crown 18 is formed from a single can carton, for example a 12 can carton (FIGS. 4 and 6), an 18 can carton (FIGS. 5 and 6), or a 24 can carton (FIGS. 7 and 8).

Figure 9:
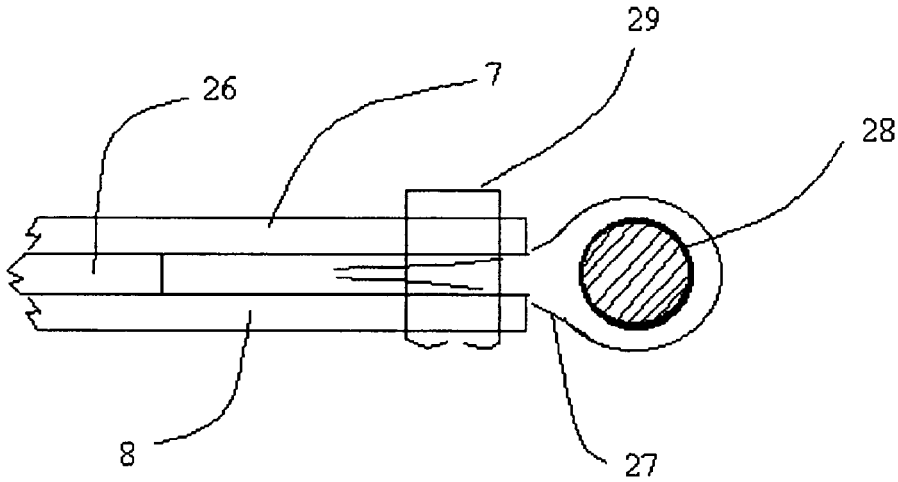
FIG. 9 is a cross-section through the brim of a hat.

In order to be able to form the brim of the hat in a desired shape, it is preferable to reinforce the brim with a material that will hold the brim in position after it has been shaped. This can be accomplished in several ways. Referring to FIG. 9, duck tape 27 has be wrapped over wire 28. Other materials, such as cloth, plastic, or rubber, could also be used instead of duck tape 27. Wire 28 can be supplied with the carton or a stiff wire, such as a coat hanger wire, can be used. Duck tape 27 and tabs 26 of crown 18 are inserted in between upper brim 7 and lower brim 8. Upper brim 7, lower brim 8, and duck tape 27 are stapled together with staples 29.

Figure 10:
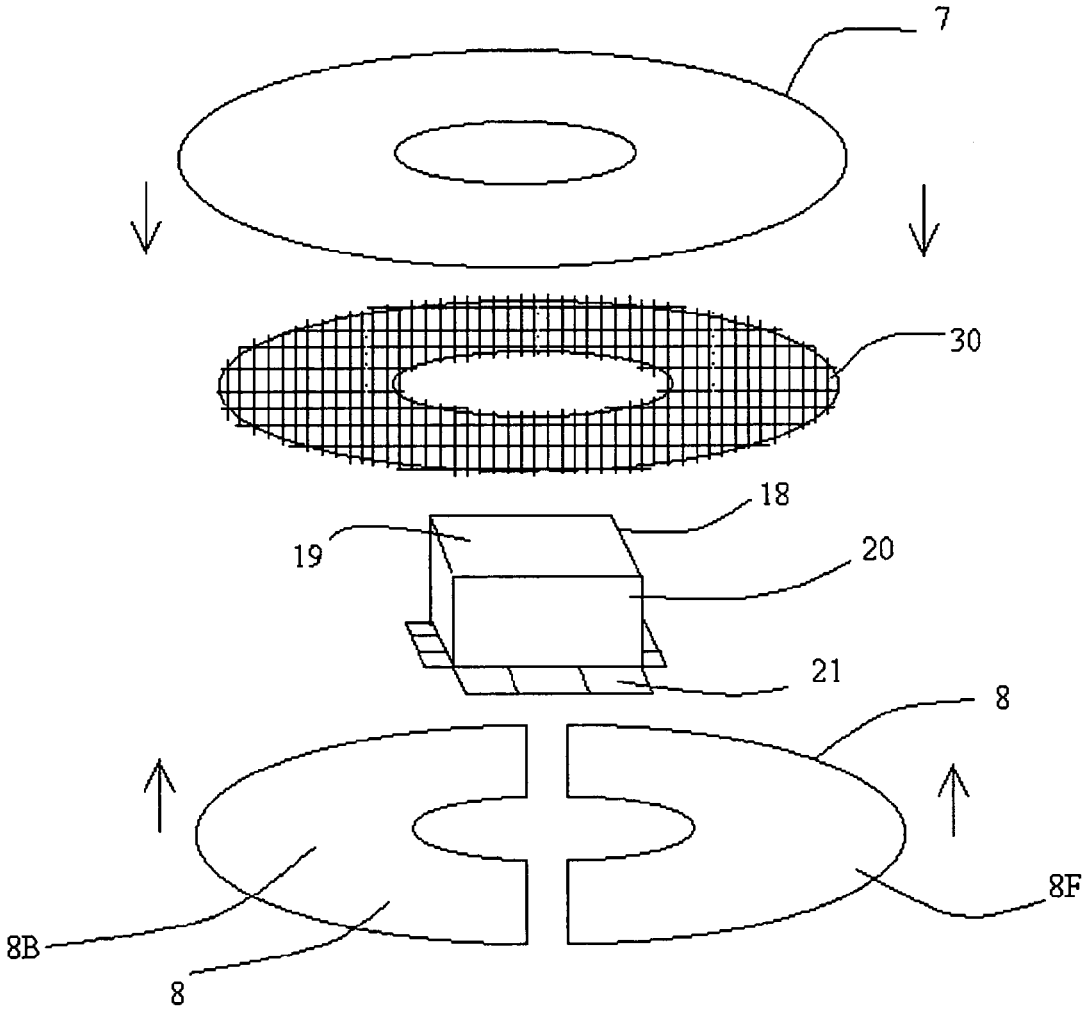
FIG. 10 is an exploded isometric side view showing the assembly of a hat.
Figure 11:
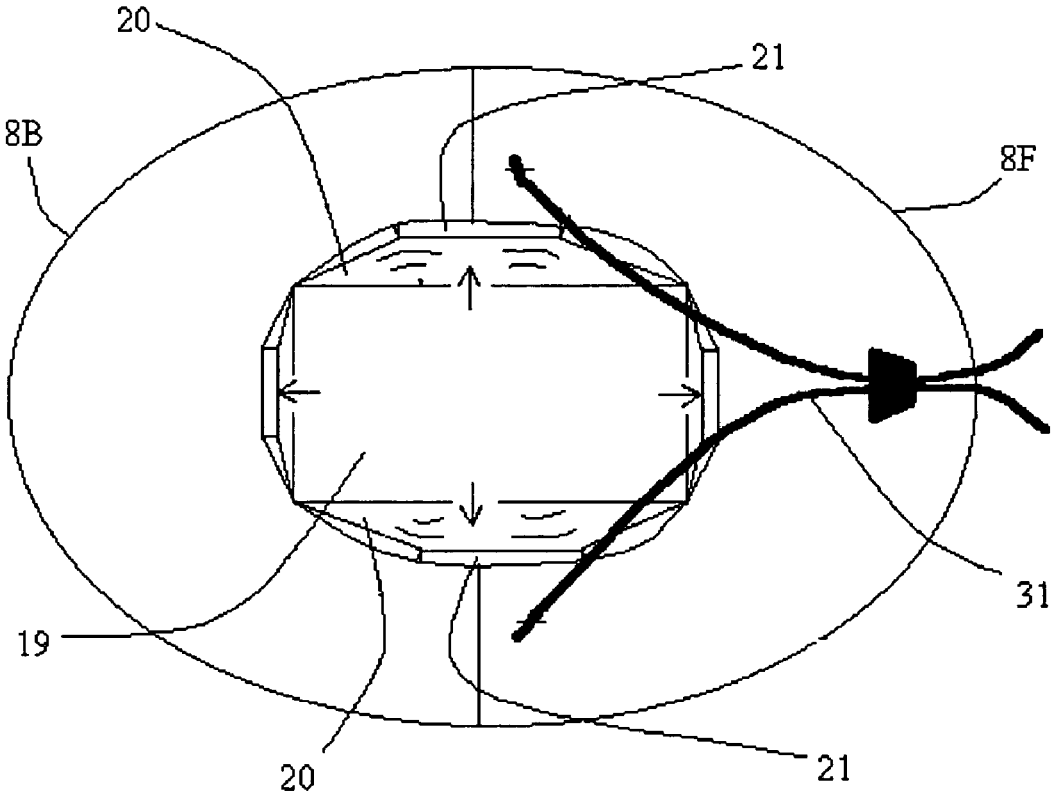
FIG. 11 is a view looking up at the bottom of a hat.

As another alternative, in FIG. 10, a piece of wire mesh 30 is positioned in between upper brim 7 and lower brim pieces 8F and 8B. Tabs 21 are also positioned in between upper brim 7 and lower brim pieces 8F and 8B, either above or below wire mesh 30. Other materials that can be bent and will then retain their shape, such as sheet metal or aluminum sheet, could also be used: Upper brim 7, wire mesh 30, and lower brim pieces 8F and 8B are then fixed together using either staples, glue, single or double sided tape, stitching, or other means. Care is taken to avoid sealing upper brim 7 and lower brim pieces 8F and 8B near crown 18, 50 that tabs 21 can slide in between upper brim 7 and lower brim pieces 8F and 8B. This permits sides 20 of crown 18 to move outward to accommodate the shape of a person's head. FIG. 11 shows how sides 20 can move outward as tabs 21 slide in between upper brim 7 and lower brim pieces 8F and 8B. Because there is a gap between the sides 20 of crown 18 and brim 7 so that sides 20 are not in contact with brim 7, sides 20 can be pushed outward into that gap as the hat is pressed downward onto a person's head. Also, in FIG. 11 chin strap 31 has been attached to the underside of lower brim 8. This can be accomplished, for example, using glue, staples, or tape, or other suitable means, or by inserting the ends through holes in the brim and tying knots at the ends. Chin strap 31 fits under the chin of the wearer of the hat to help hold the hat on his head, or around the neck of the wearer if the hat is worn on his shoulders.

Figure 12:
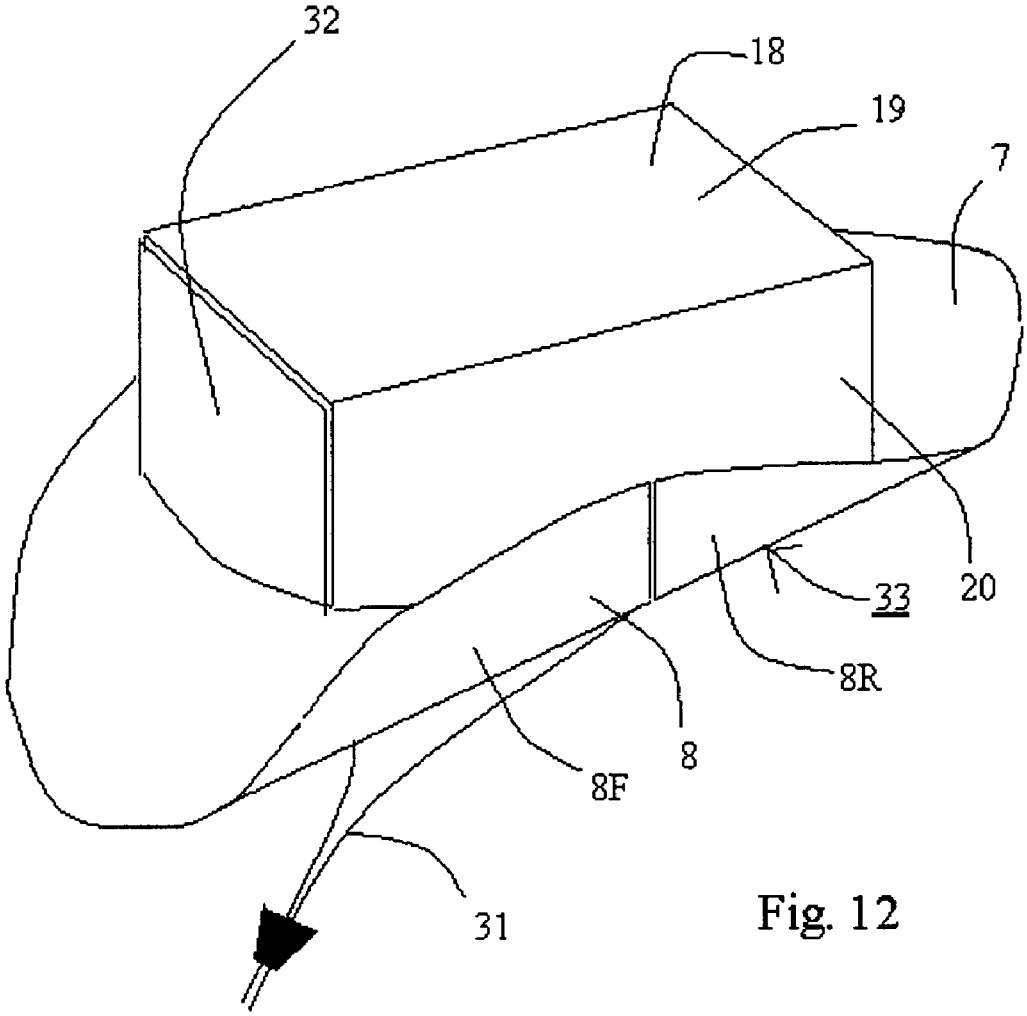
FIG. 12 is an isometric view of an assembled hat.

In FIG. 12, manufacturer's logo piece 32 is glued, stapled, or otherwise attached to the front of completed hat 33.

While the drawings show one style of hat, it will be appreciated that patterns can also be designed for other styles of hats, such as a baseball cap, a tri-corner hat, a stovepipe hat, a top hat, Santa Claus hat, a graduation cap, or a beret.

The invention claimed is:

1. A method of making a hat comprising (A) cutting pieces out of at least two can cartons in patterns suitable for forming (1) a brim having a central opening; and (2) a crown having a rectangular cross-section that is insertable into said central opening, where the bottom of said crown has tabs extending from its sides for slideably engaging said brim and said sides are not in contact with said central opening, whereby there is a gap between said crown and said opening; and (B) assembling said pieces into said hat by inserting said crown into said central opening and attaching said crown to said brim, whereby said sides can expand outwardly.

2. A method according to claim 1 wherein said crown is cut from a single can carton.

3. A method according to claim 1 wherein said pieces for said brim include an upper brim and a lower brim and said tabs slide in between said upper brim and said lower brim.

4. A method according to claim 3 wherein wire mesh is sandwiched between said upper brim and said lower brim.

5. A method according to claim 1 wherein said crown is formed from a 12 can carton or an 18 can carton.

6. A method according to claim 1 wherein a wire is attached to said brim to hold said brim in a desired shape.

7. A method according to claim 1 including attaching a chin strap to said brim.

8. A method according to claim 1 including the steps of cutting out a logo piece from a can carton and attaching said logo plate to said hat.

9. A method according to claim 1 wherein said can cartons are selected from the group consisting of 12 can cartons about 7¾ inches high, about 10½ inches long, and about 4¾ inches wide, 18 can cartons about 7¾ inches high, about 15½ inches long, and about 4¾ inches wide, and 24 can cartons about 10½ inches high, about 15½ inches long, and about 4¾ inches wide.

10. A method according to claim 1 wherein said patterns are marked on said can cartons by a cutting tool as it cuts said pieces from said can cartons.

11. A method according to claim 1 wherein said patterns are marked on said cartons before said pieces are cut.

12. A method according to claim 1 wherein said pieces are cut out of can cartons for holding 12 oz cans.

13. A hat made according to the method of claim 1.

14. A method of making a hat comprising (A) cutting out pieces from at least two can cartons for making (1) a brim having an upper portion and a lower portion and a central opening therethrough;

(2) a crown that is insertable into said central opening, where the bottom of said crown has tabs extending from its sides for slideably engaging said brim and said sides are not in contact with said central opening, whereby there is a gap between said crown and said opening; and (3) a logo piece; and (B) assembling said pieces into said hat by inserting said crown into said central opening with said tabs in between said upper portion and said lower portion, whereby said sides can expand outwardly.

15. A method according to claim 14 wherein said pieces are cut out of can cartons for holding 12 oz cans.

16. A hat made according to the method of claim 14.

17. A method of making a hat comprising (A) cutting a logo piece out of a can carton;

(B) cutting out pieces to form a brim for said hat from a can carton, where said brim has an upper portion and a matching lower portion and a central opening therethrough;

(C) cutting out a single piece to form a crown for said hat, where said crown has a rectangular cross-section that is insertable into said central opening, there is a gap between the bottom of said crown and said opening, the bottom of said crown has tabs extending from its sides for slideably engaging said brim, and said sides are expandable outwardly into said central opening; and (D) assembling said pieces into said hat by inserting said crown into said central opening with said tabs in between said upper portion and said lower portion, whereby said sides can expand outwardly.

18. A method according to claim 17 wherein said pieces are cut out of can cartons for holding 12 oz cans.

19. A hat made according to the method of claim 17.

* * * * *